US005823742A

United States Patent [19]

Giddings

[11] Patent Number: 5,823,742

[45] Date of Patent: Oct. 20, 1998

[54] VARIABLE AND BIDIRECTIONAL STEAM FLOW APPARATUS AND METHOD

[75] Inventor: John R. Giddings, Wellsville, N.Y.

[73] Assignee: Dresser-Rand Company, Corning, N.Y.

[21] Appl. No.: 573,293

[22] Filed: Dec. 15, 1995

[51] Int. Cl.[6] ..... F04D 29/56

[52] U.S. Cl. ..... 415/150; 415/155; 137/883

[58] Field of Search ..... 415/9, 150, 155; 137/867, 883

[56] References Cited

U.S. PATENT DOCUMENTS

| | | | |
|---|---|---|---|
| 1,235,936 | 8/1917 | Shaw . | |
| 2,147,874 | 2/1939 | Zetterquist | 415/155 |
| 2,247,378 | 7/1941 | Hinrichs . | |
| 2,294,127 | 8/1942 | Pentheny | 415/155 |
| 2,794,616 | 6/1957 | Bernasconi . | |
| 2,978,223 | 4/1961 | Keeney et al. . | |
| 3,152,601 | 10/1964 | Krenikoff | 415/49 |
| 3,642,381 | 2/1972 | Wickl . | |
| 4,456,032 | 6/1984 | Straslicka | 415/155 |
| 4,840,793 | 7/1989 | Silvestri, Jr. et al. | 415/155 |
| 4,847,039 | 7/1989 | Kendall et al. | 415/155 |
| 5,333,989 | 8/1994 | Missana et al. | 415/150 |

FOREIGN PATENT DOCUMENTS 265310 11/1986 Japan ..... 415/9

*Primary Examiner*—John T. Kwon

*Attorney, Agent, or Firm*—Nixon, Hargrave, Devans & Doyle LLP

[57] ABSTRACT

A valve apparatus for a turbomachine comprises a manifold casing, a valve lift assembly, and a plurality of valve assemblies. The manifold casing defines a valve inlet chamber and has a top wall and a bottom wall with a plurality of vertically disposed openings through the top wall and a plurality of openings to vertically disposed passages in the bottom wall. The passages each extend away from the bottom wall to a passage exit. The valve lift assembly comprises a plurality of lift bars and a plurality of lift pins. The lift pins extend vertically through the vertically disposed openings at the top wall of the manifold casing. A plurality of valve assemblies equal in number to that of vertically disposed passages in the bottom wall each comprise a valve configured to fit scalingly against the corresponding vertically disposed opening and a valve stem with one end connected to a corresponding valve and an opposite end connected to a valve stop shoulder to place each of the valve assemblies in movable association with at least one of said lift bars.

29 Claims, 8 Drawing Sheets

VARIABLE AND BIDIRECTIONAL STEAM FLOW APPARATUS AND METHOD

FIELD OF THE INVENTION

The present invention relates generally to steam turbomachines and, more particularly, to an apparatus and method for controlling and directing a flow of steam bidirectionally through such turbomachines.

BACKGROUND OF THE INVENTION

The proper regulation of steam flow in turbomachinery, especially steam turbines is critical to the proper operation, maintenance and longevity of steam turbine equipment. It is known that the initial introduction of steam to a turbine must be accomplished systematically, to deliver the appropriate amount of force to the turbine blades while also allowing the turbine housings to become exposed to the increasing temperature in a balanced fashion, thus avoiding excessive material fatigue.

Many large steam turbines include multiple nozzle chambers with operable valves to direct steam first to a turbine nozzle or nozzle ring, and then to turbine blades causing their rotation. The steam which enters the nozzle chambers is regulated by valves which open and close to regulate the amount of steam to be passed through to the nozzle chamber. U.S. Pat. Nos. 2,294,127 and 2,978,223 disclose a turbine apparatus having multiple valves being sequentially movable to progressively increase, and selectively direct, steam flow to the turbine blades of a turbine engine. However, such designs have been improved to seek ever greater efficiency.

In steam turbine operation, an efficiency savings of even 1 or 2% can result in significant operational cost savings. Even the best presently-used steam turbine systems have a degree of leakage in their operation. In many turbine designs, a 2–3% drop in system efficiency results from leakage at the high pressure port of the steam inlet, where the steam enters the steam turbine. This leakage is largely due to high steam back-pressure resulting from steam needing to pass from one source, in basically one direction, through a nozzle chamber, a series of turbine wheels, and one exhaust chamber.

In addition, in extraction steam turbine engines, steam is introduced at one pressure with job requirements "downstream" requiring different output pressures. Such turbines require multiple valve body casings, which results in additional opportunities in the system for efficiency losses. Such designs have not adequately solved the problem of steam leakage and lost system efficiency. Therefore, the need remains for a bidirectional flow, steam turbine system with reduced leakage.

SUMMARY OF THE INVENTION

One embodiment of the present invention relates to a valve apparatus for a turbomachine comprising a manifold casing defining a valve inlet chamber. The manifold casing comprises a top wall and a bottom wall with a plurality of vertically disposed openings through said top wall, and a plurality of openings to vertically disposed passages in said bottom wall with the passages each extending away from said bottom wall to a passage exit. The manifold casing further houses a valve lift assembly comprising a plurality of lift bars, and a plurality of lift pins. The lift pins extend vertically through the vertically disposed openings at the top wall of the manifold casing. The manifold casing further houses a plurality of valve assemblies equal in number to that of vertically disposed passages in the bottom wall with the valve assemblies comprising a valve configured to fit sealingly against the corresponding vertically disposed opening and a valve stem with one end connected to a corresponding valve and an opposite end connected to a valve stop shoulder to place each of the valve assemblies in movable association with at least one of said lift bars.

Another embodiment of the present invention relates to a steam turbine comprising a large exhaust housing, a small exhaust housing, a plurality of diaphragms positioned within the exhaust housings comprising a stationary set of blades for directing steam flow, and a plurality of rotatable turbine wheels positioned within the exhaust housings and mounted onto a turbine shaft and positioned adjacent said diaphragms, with the turbine wheels having a set of blades. The steam turbine further comprises a valve housing configured to fit sealingly between the small and large exhaust housings, said valve housing comprising a manifold casing defining a valve inlet chamber, with the manifold casing comprising a top wall and a bottom wall with a plurality of vertically disposed openings through said top wall, and a plurality of openings to vertically disposed passages in said bottom wall, with the passages each extending away from said bottom wall to a passage exit. The manifold casing further comprises a valve lift assembly comprising a plurality of lift bars, and a plurality of lift pins, said lift pins extending vertically through the vertically disposed openings at the top wall of the manifold casing, and a plurality of valve assemblies equal in number to that of vertically disposed passages in the bottom wall, said valve assemblies comprising a valve configured to fit sealingly against the corresponding vertically disposed opening and a valve stem with one end connected to a corresponding valve and an opposite end connected to a valve stop shoulder to place each of the valve assemblies in movable association with at least one of said lift bars.

In a further embodiment, the present invention relates to a turbine comprising a port ring nozzle assembly comprising a plurality of ports at least equal to the number of the above-described vertically disposed passages in the manifold casing, said nozzle assembly disposed such that said ports abut the passage exits, with a first set of ports dedicated to direct a flow of steam in a first direction, and a second set of ports dedicated to direct a flow of steam in a second direction substantially opposite to the first direction.

A still further embodiment of the present invention relates to a bidirectional flow port ring nozzle assembly for a turbomachine comprising a first and second side, and a top and a bottom, and having a plurality of ports equal in number to and aligned with a plurality of passage exits from a valve housing, said ports originating in the nozzle assembly top and extending into the ring nozzle and exiting from either the first or second side of the ring nozzle, said top of the nozzle assembly configured to fit sealingly against the valve housing, with a first set of ports dedicated to direct a liquid flow in a first direction, and a second set of ports dedicated to direct a liquid flow in a second direction substantially opposite to the first direction.

Another embodiment of the present invention relates to a method for admitting a controlled steam flow through a turbomachine comprising providing a control system comprising a plurality of valve assemblies located within a manifold casing of a steam valve housing, said valve assemblies comprising a valve, a valve stem, and a valve stop shoulder. A valve assembly is attached to a lift bar assembly by passing said valve stem through openings in the lift bar and placing said stop shoulder on the valve stem to retain said valve stem on said lift bar. A lift bar assembly is then attached to an actuating mechanism and a steam flow is admitted to the steam valve housing. An actuating mechanism is actuated to raise said lift bar assembly such that at least one valve is raised from a corresponding valve seat covering a passage to a port in a ring nozzle assembly. A steam flow is then passed through the valve passage into the corresponding port in the ring nozzle assembly, with said steam directed through said ring nozzle assembly in at least one direction.

DETAILED DESCRIPTION OF THE DRAWINGS

Figure 1:
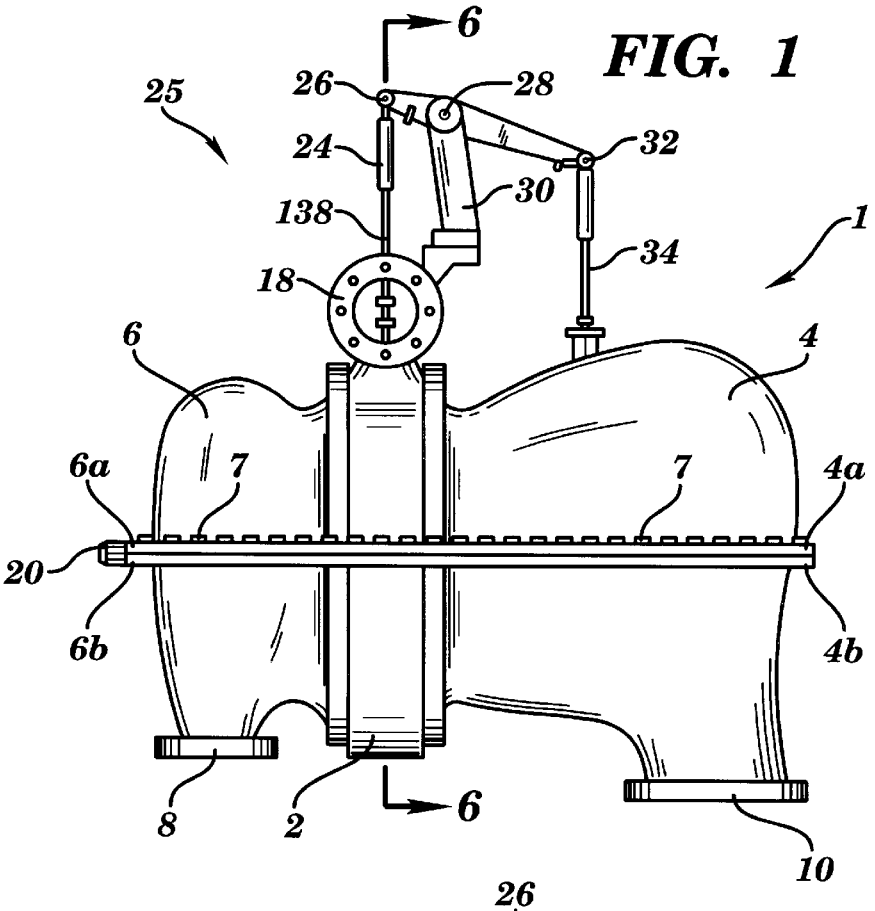
FIG. 1 is a side view of a turbomachine in accordance with the present invention.
Figure 2:
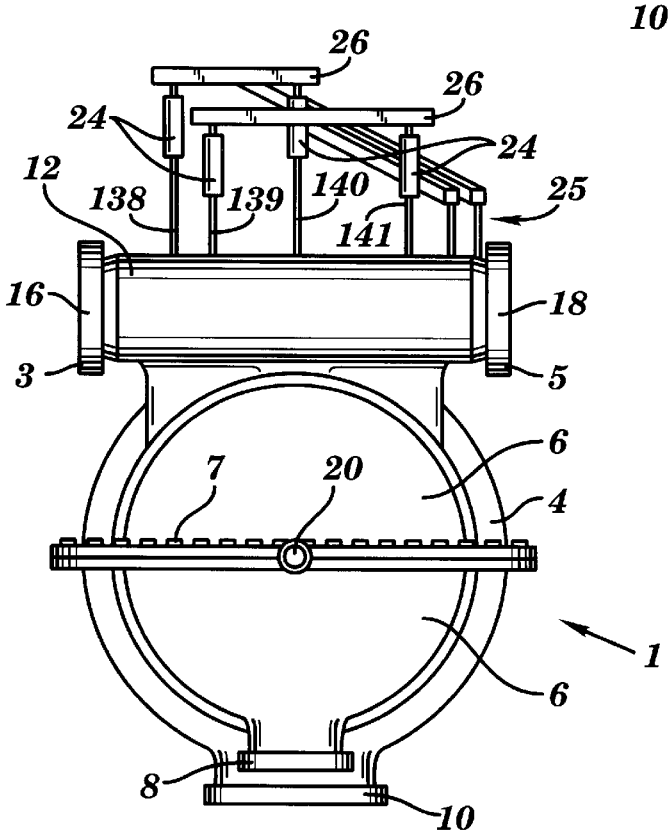
FIG. 2 is an end view of one end of a turbomachine valve assembly in accordance with the present invention.

Referring to the drawings, FIGS. 1 and 2 show a side and front view, respectively, of a turbine assembly 1. A valve housing 2 is positioned and secured into place between a large exhaust housing 4 and a small exhaust housing 6. The small and large exhaust housings have small and large exhaust flanges 8, 10 respectively. The valve housing 2 has a manifold casing 12 which defines a gas inlet chamber. The manifold casing 12 has two intakes 16, 18 where liquid or gas (e.g. steam) is introduced to the turbine assembly. A turbine shaft 20 is shown extending from the small exhaust housing 6. The exhaust housings are typically machined into upper parts 4*a*, 6*a* and lower parts 4*b*, 6*b* which may be attached together with connectors, preferably bolt assemblies 7. The upper and lower housing parts are separable to allow for maintenance and servicing of the turbine blades and components contained within. In FIG. 1, lift pins 138–141 are shown extending vertically upward through the manifold casing 12, and attaching to an actuating mechanism 37. The actuating mechanism preferably consists of either ganged or individual actuators of pneumatic, hydraulic, mechanical or electrical type.

Figure 3:
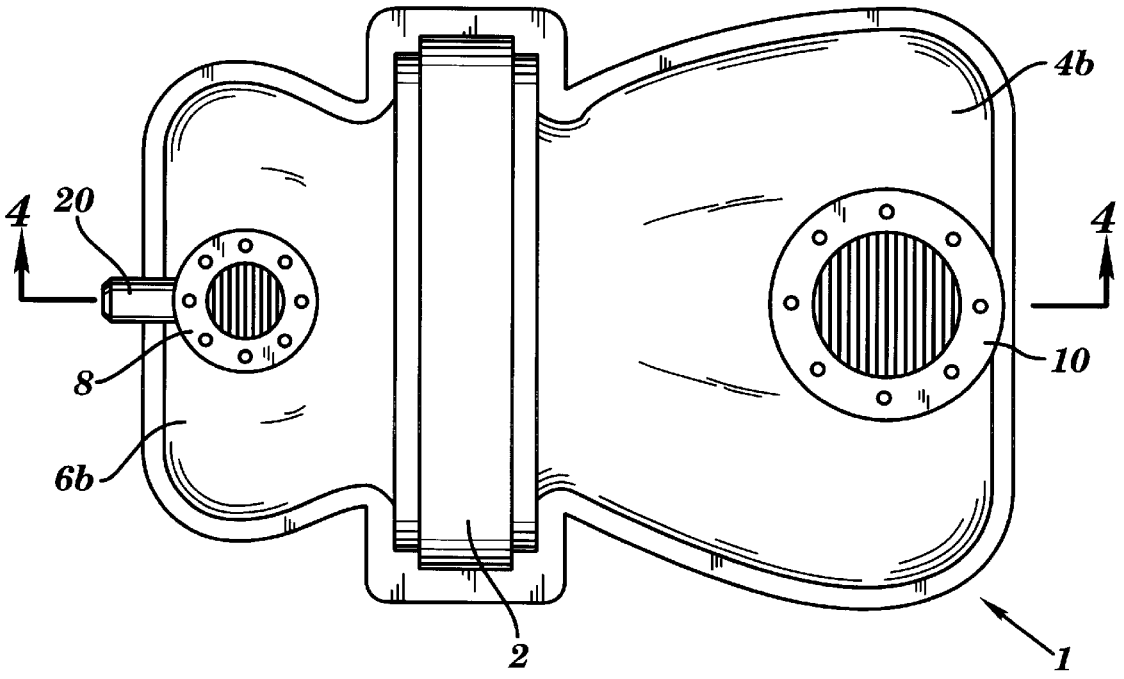
FIG. 3 is a bottom view of a turbomachine in accordance with the present invention.
Figure 4:
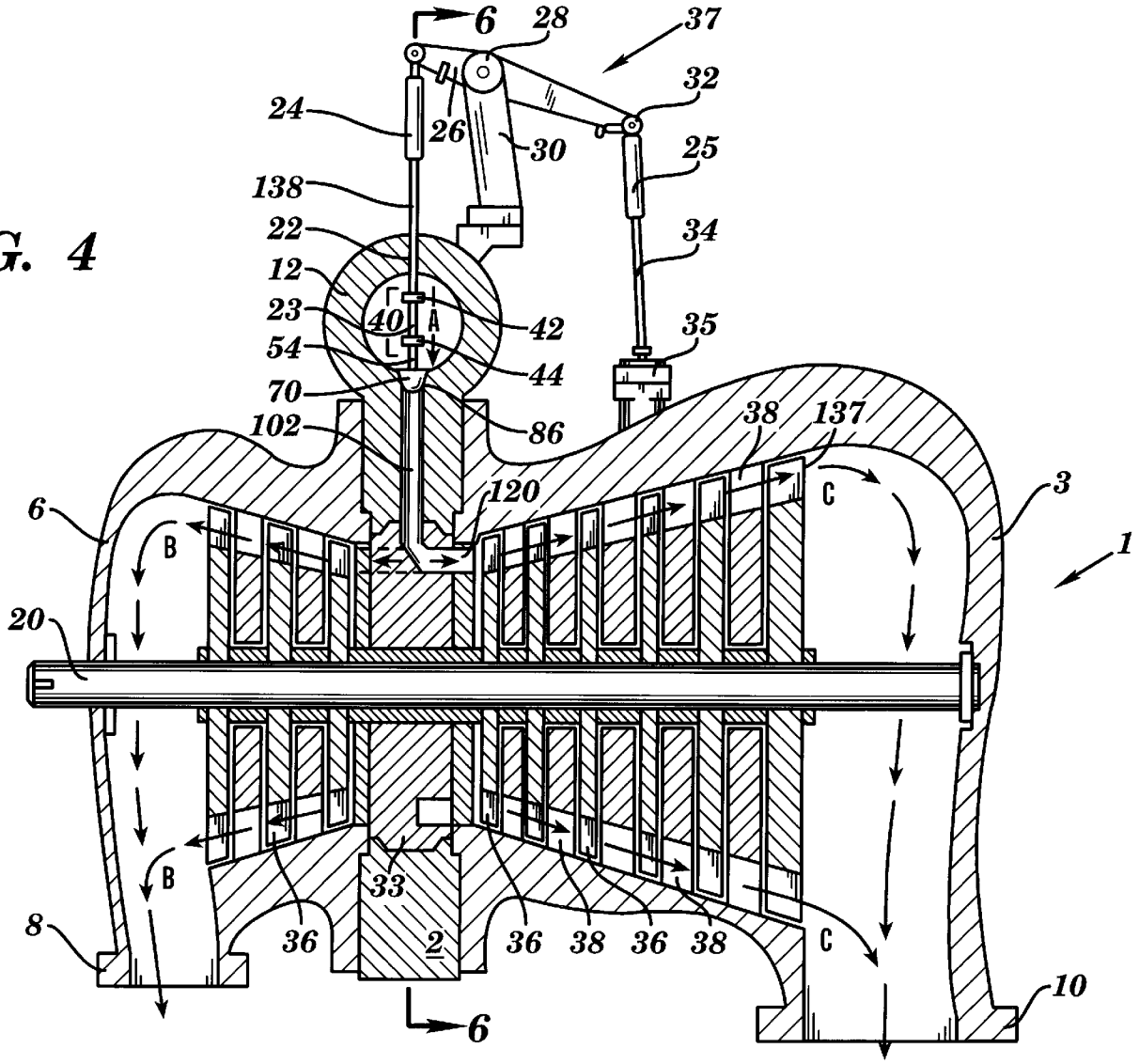
FIG. 4 is a cross-sectional view of a turbomachine along line 4—4 of FIG. 3.

FIG. 4 shows a cross-sectional view of the turbine assembly 1 as viewed along line 4—4 of FIG. 3. Within the large exhaust and small exhaust housings 4, 6 are located a series of turbine wheels 36 of varying diameters which are attached to the turbine shaft 20.

Diaphragms 38 are juxtaposed between adjacent turbine wheels 36. Located within the manifold casing 12, is a lift bar assembly 40, having an upper lift bar 42 and a lower lift bar 44. A lift pin 138 is shown extending from the lower lift bar 44 through the upper lift bar 42 through an opening 22 in the upper wall of manifold casing 12. The lift pin is attached to an actuator mechanism 25. The actuator comprises a connector 24 which attaches to the lift pins 138–141. A first end of a pivot arm 26 connects to the connector 24. The pivot arm is fastened to a support 30 which is attached to the manifold housing 12. The pivot arm 26 is secured to the support 30 at point 28 to allow the arm 26 to pivot about point 28. The second end of pivot arm 26 is connected to rod 34 at point 32. Rod 34 extends into actuator 35 and attaches to a piston mechanism (not shown). A valve stem 54 is shown attached to valve 70 which is resting in valve seat 86. The valve seat 86 is positioned at the top of passage 102 which extends to port ring nozzle assembly 120. As a result, steam entering passage 102 along the path defined by arrow A passes through valve housing 2 to turbine wheels 36.

Figure 5:
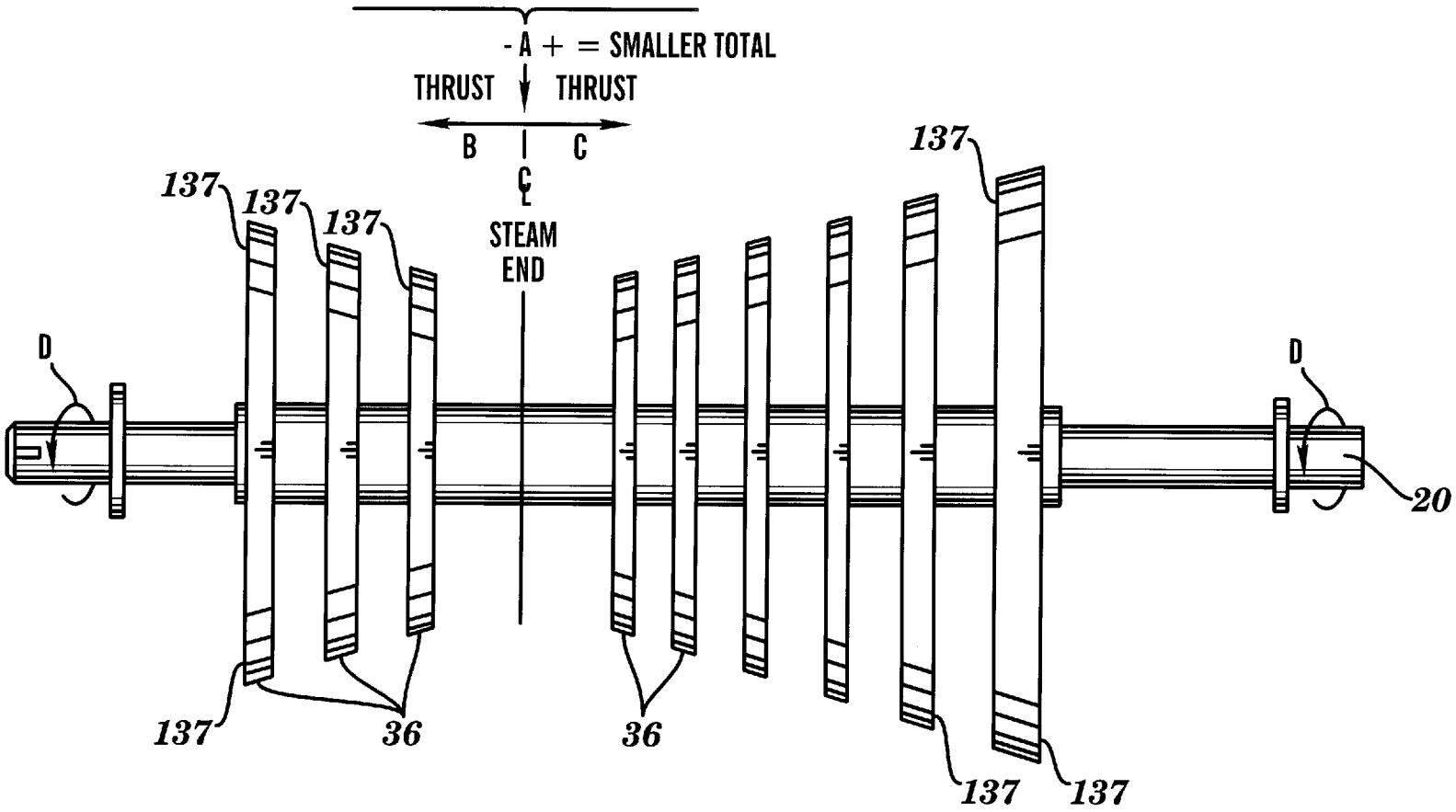
FIG. 5 is a sideview of turbine wheels of a turbomachine in accordance with the present invention showing the bidirectional flow of steam through the turbine.

FIG. 5 shows turbine wheels 36 attached to turbine shaft 20 and their relationship with steam flow paths A, B, and C. It is understood that the turbine wheels preferably may be integrally forged onto the shaft, or may be shrunk fit onto the shaft. Rows of turbine blades 137 are circumferentially distributed around the outer circumference of the turbine wheels 36. The impact of the steam flow on the turbine wheels in the direction of arrows B and C together results in a rotational force on the turbine shaft 20 as shown by arrow D. As explained in more detail below, the thrust experienced by the turbine assembly due to the steam flow in the direction of arrow B is arbitrarily assigned a "−" value. Similarly, the thrust experienced by the turbine assembly due to the steam flow in the direction of arrow C is assigned a "+" value.

Figure 6:
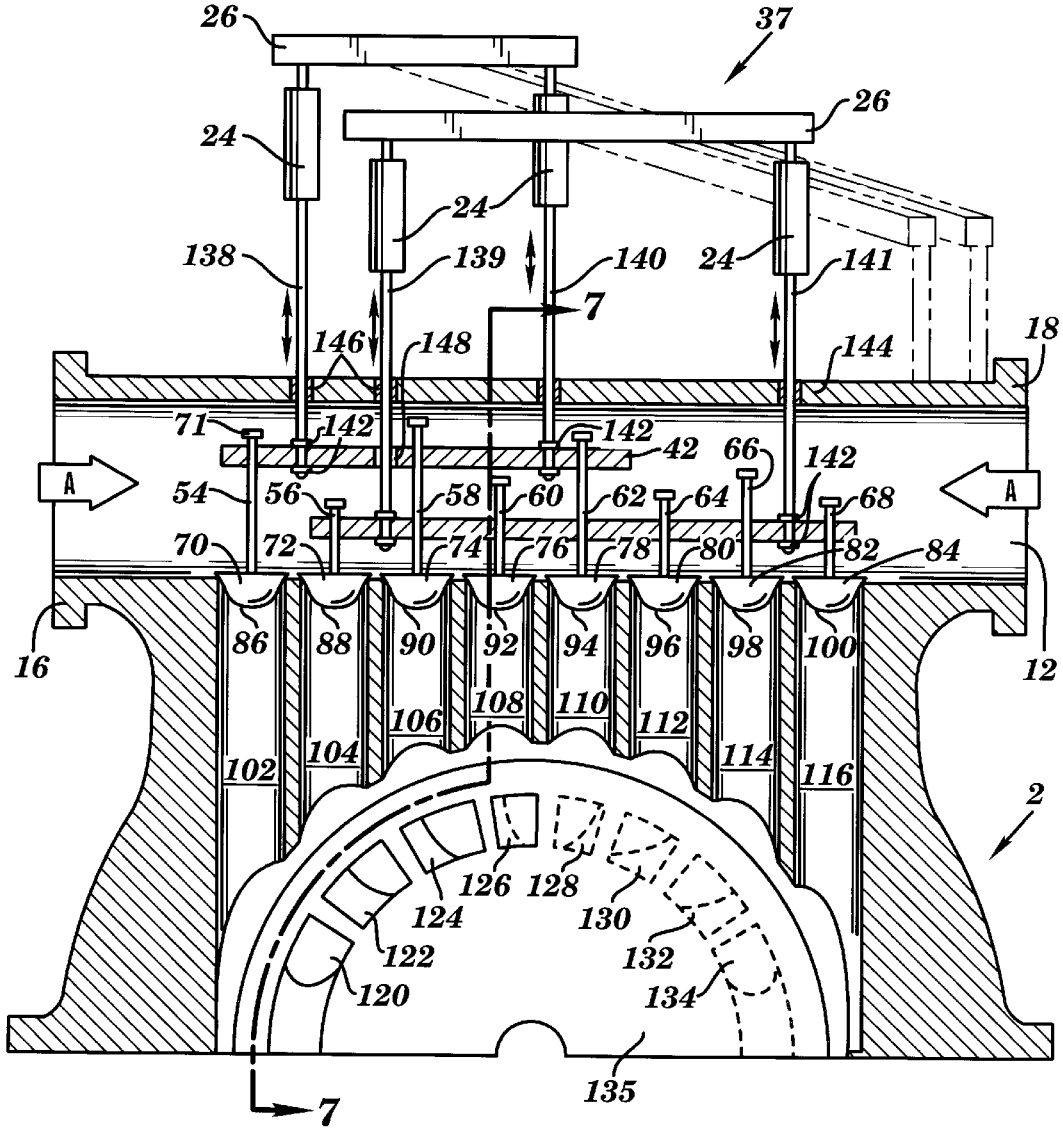
FIG. 6 is a cross-sectional view of a manifold casing positioned on top of a turbomachine along line 6—6 of FIG. 1.

FIG. 6 is a cross-sectional view of the valve chamber 2 viewed along line 6 of FIG. 4. Steam enters manifold casing 12 from inlets 16, 18 in the direction of arrows A. It is understood that the horizontal inlet direction A will become a vertical direction A as the valves lift from their seats to allow flow into the passages. A series of valves 70, 72, 74, 76, 78, 80, 82, 84 (collectively referred to as valves 70–84) having valve stems 54, 56, 58, 60, 62, 64, 66, 68 (collectively referred to as valve stems 54–68) are shown resting in valve seats 86, 88, 90, 92, 94, 96, 98, 100 (collectively referred to as valve seats 86–100) which define openings to passages 102, 104, 106, 108, 110, 112, 114, 116 (collectively referred to as passages 102–116). Valve stems 54–68 having varying lengths as measured from the valve to valve stop shoulders 71, are shown extending vertically upward from valves 70–84, respectively. The valve stops preferably machined into the stems are considered to be shoulders, but may be separate pieces such as stop nuts fixedly attached to matching threads (not shown) on the uppermost part of the valve stems. Each valve stem extends through an opening in at least one of the upper lift bar 42 and/or lower lift bar 44. The valve stop shoulders or nuts 71 have a diameter larger than the diameter of the openings in lift bars 42, 44. Lift pins 138 and 140 are shown fixedly attached to upper lift bar 42 via lift pin nuts 142, while lift pins 139 and 141 are fixedly attached to lower lift bar 44 via lift pin nuts 142. Lift pins 138–141 extending through upper wall 144 of manifold casing 12 through openings 146, have a diameter only slightly smaller than the diameter of openings 146, to prevent steam leakage therethrough. Lift pin 139 also extends through and moves freely through an opening 148 in the upper lift bar 42. Above the manifold casing 12, lift pins 138–141 are connected to actuating mechanisms 37 for lifting and lowering lift pins 138–141 in a desired sequence to regulate steam flow through the valve passages 102–116. Port ring nozzle assembly 135 is located such that ports 120, 122, 124, 126, 128, 130, 132, 134 (collectively referred to as ports 120–134) present on port ring 135 are brought into close association, with and sealingly fitted against, the bottom ends of passages 102–116.

Figure 7:
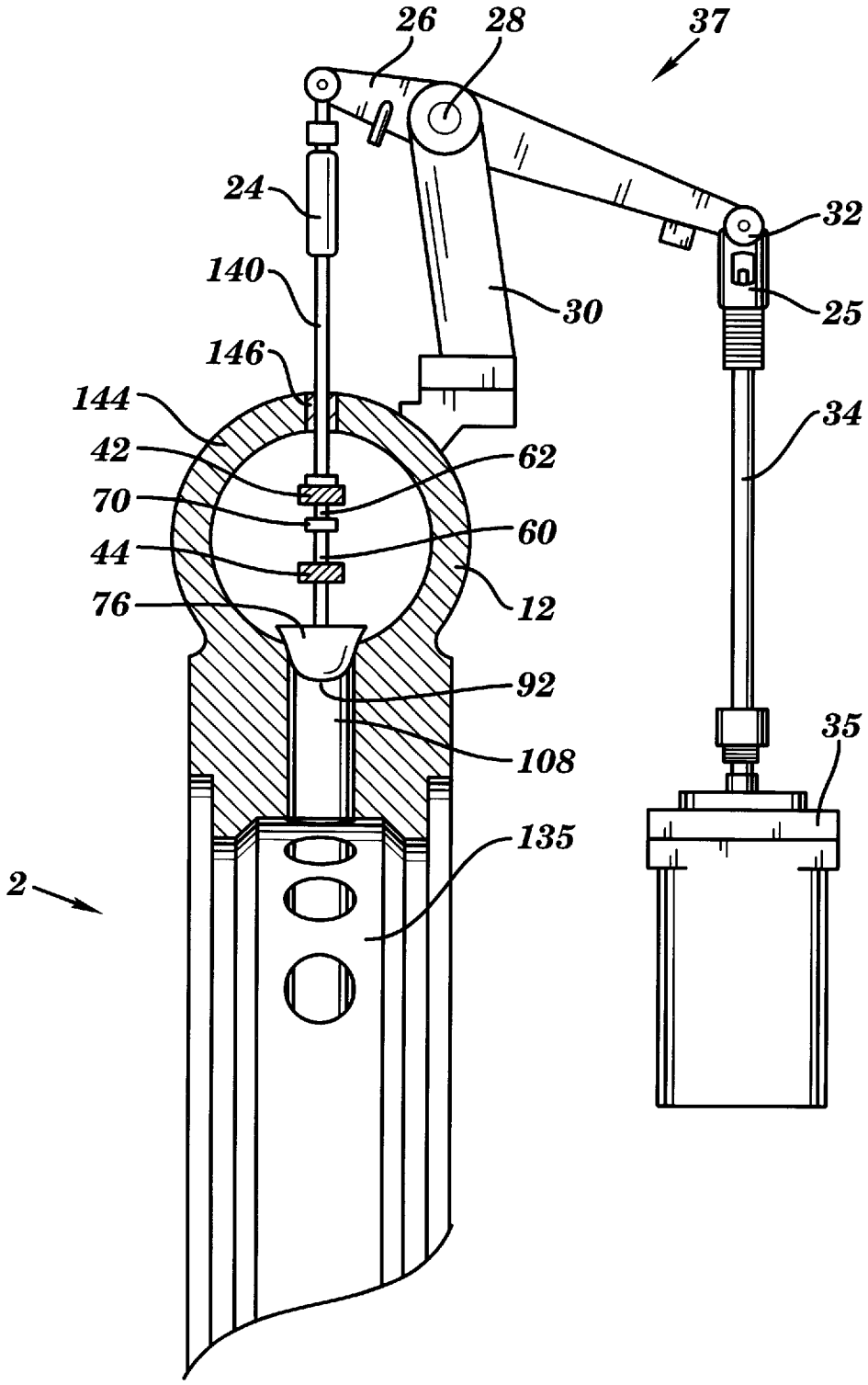
FIG. 7 is a side cross-sectional view of the manifold casing along line 7—7 of FIG. 6.

FIG. 7 is a cross-sectional view of the valve chamber 2 viewed across line 7—7 of FIG. 6. Valve 76 is shown resting in valve seat 92 of valve passage 108. Valve stem 60, connected to valve 76, extends vertically upward through lower lift bar 44, and connects to valve stop shoulder 71. A portion of valve stem 62 attached to another valve 44 (shown in FIG. 4) is partially visible. Upper lift bar 42, connected to lift pin 140, extends through opening 146 in upper wall 144 of manifold casing 12 and attaches to connector 24 of actuating mechanism 37.

Figure 7A:
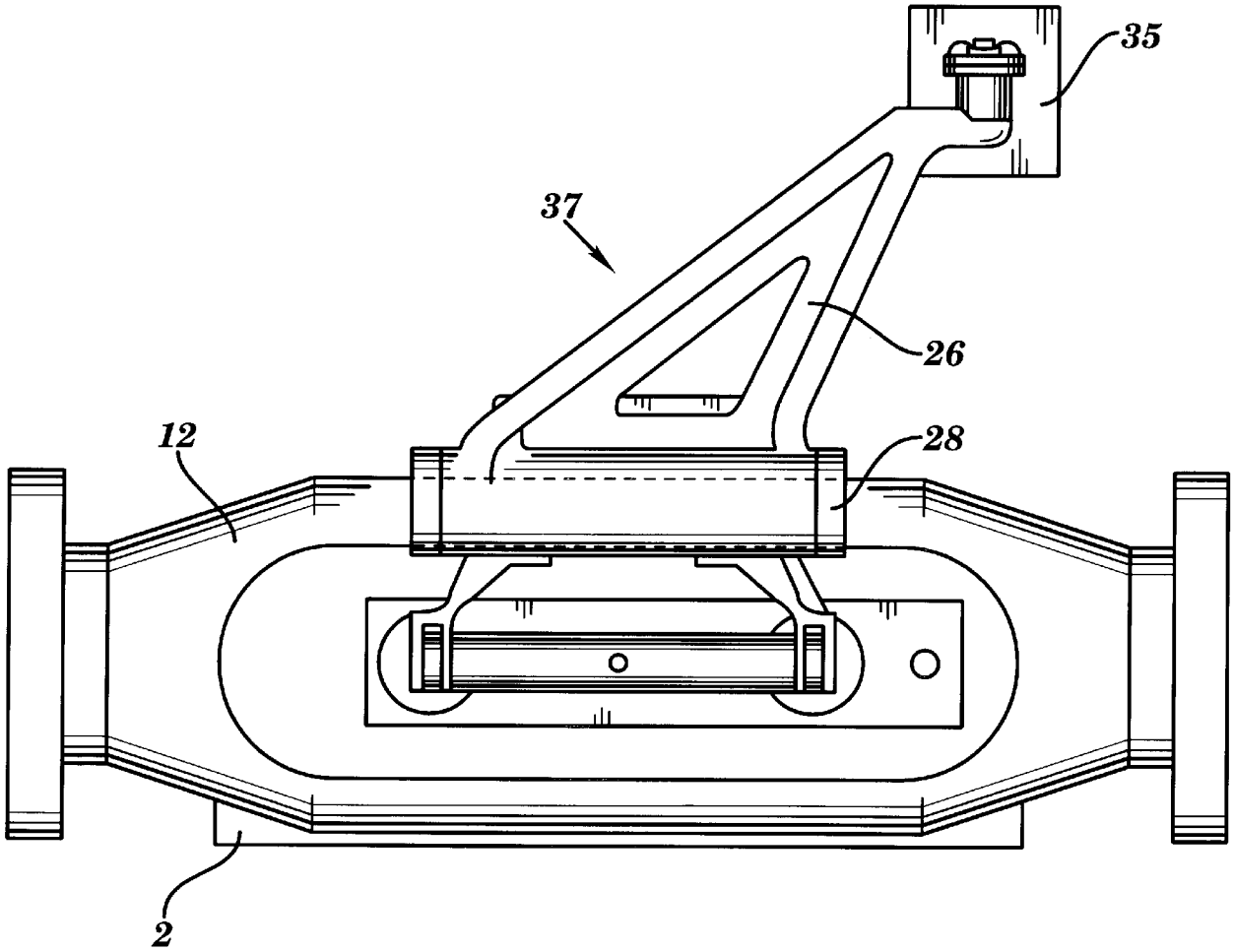
FIG. 7*a* is an overhead view of the manifold casing.

FIG. 7*a* shows an overhead view of the manifold casing 12 of the valve housing 2. For simplicity, only one of the actuating mechanisms 37 is shown in this view. It is to be understood, as shown in FIG. 6, two actuating mechanisms are preferably used to raise the four lift pins which extend through the top wall of manifold casing 12.

Figure 9:
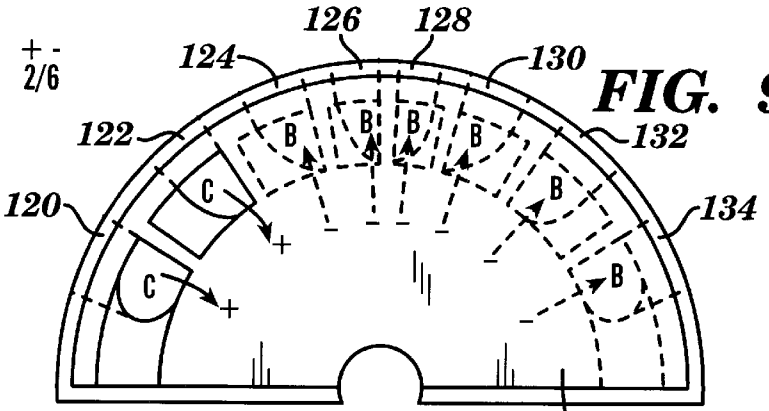
FIG. 9 is a cross-sectional view of the upper-half of a ring port assembly in accordance with the present invention showing two ports open in the "+" direction and 6 ports open in the "−" direction.
Figure 8:
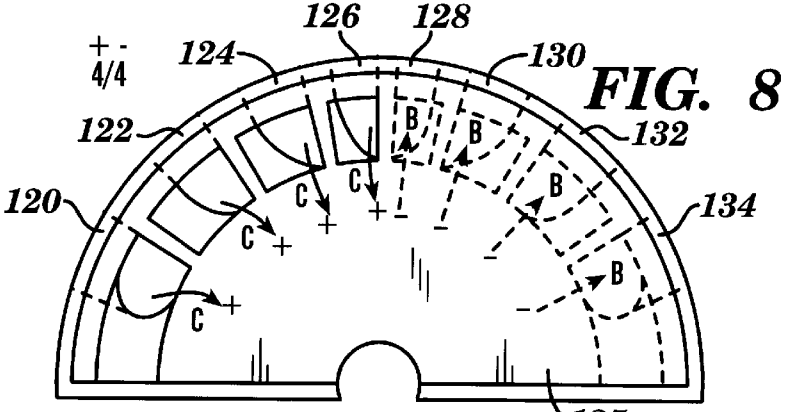
FIG. 8 is a cross-sectional view of the upper-half of a ring port assembly showing four ports open in each of the "+" and "−" directions.
Figure 10:
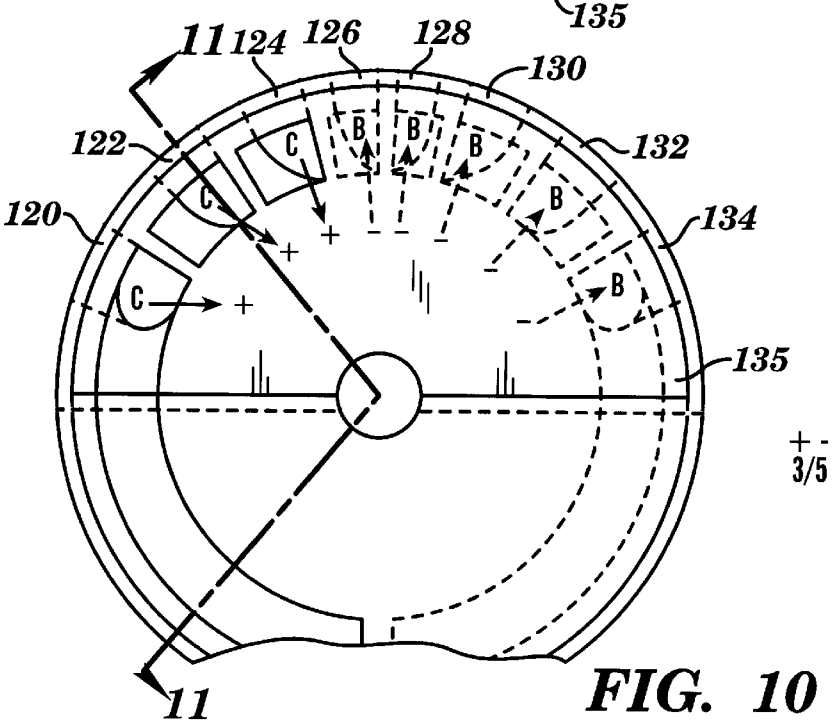
FIG. 10 is a cross-sectional view of a port ring nozzle assembly in accordance with the present invention showing three ports open in the "+" direction, and five ports open in the "−" direction.

FIGS. 8–10 show port ring nozzle assemblies 135 having a varying number of ports open in the directions shown by arrows B and C (shown in FIG. 4). Passages 102–116 (see FIG. 6) extend into ports 120–134 respectively. In FIG. 8, four ports 120, 122, 124, 126 allow flow in the "+" direction indicated by solid arrows corresponding to the steam flow direction of the "C" arrow. Four ports 128, 130, 132, 134 allow flow in the "−" direction corresponding to the steam flow in the direction of broken-line "B" arrows. In FIG. 9, two ports 120, 122 allow flow in the "+" direction of arrow C and six ports 124, 126, 128, 130, 132, 134 allow flow in the "−" direction of broken-line B arrows. In FIG. 10, three ports 120, 122, 124 allow flow in the "+" direction of arrow C and five ports 126, 128, 130, 132, 134 allow flow in the direction of the broken-line B arrows. The lower half of the port ring nozzle assembly 135 is also shown in FIG. 10.

Figure 11:
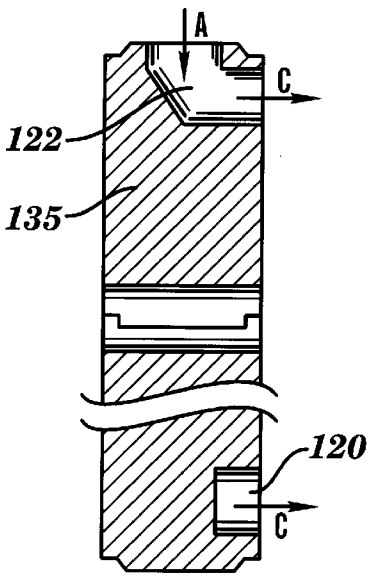
FIG. 11 is a side view of the port ring nozzle assembly of FIG. 10 viewed along line 11—11.

FIG. 11 is a cross-sectional side-view of the port ring assembly 135 viewed along line 11—11 of FIG. 10. The passage 104 (see FIG. 6) extends to meet port 122. The steam flow entering the port 122 in the direction indicated by arrow A is re-directed at about a 90° angle, and toward the turbine blades 137 of turbine wheels 36 (not shown in FIG. 11) in the new flow direction as indicated by arrow C. The steam flow from passage 102 (see FIG. 6) meets port 120 and is redirected as indicated by arrow C and also proceeds to the turbine blades 137 of turbine wheels 36 (not shown).

In operation, the desired thrust potential resulting from the particular combination of steam flow directed in different directions, as indicated by arrows B and C (to different sets of turbine wheels), is predetermined. In other words, a turbine assembly may be constructed to meet the demands of a particular application calling for, for example, four ports to direct steam flow to the blades of a first set of turbine wheels and diaphragms in the flow direction of arrow C, while four ports direct steam flow to the blades of a separate second set of turbine wheels and diaphragms in the flow direction of arrow B. In this way, the same amount of steam is delivered to the blades of the turbine wheels as in a conventional unidirectional systems. In addition, the bidirectional flow approach of the present invention eliminates the requirement for a high pressure end gland sealing arrangement, as there is no exposed turbine shaft at the high pressure (inlet) section of the turbine. Such novel design increases the overall efficiency of the turbine system of the present invention.

The thrust load which occurs as the steam proceeds through the ring port nozzle assembly to the turbine blades can be regulated, lessened, or practically neutralized by selectively arranging the direction ports in the port ring nozzle assembly. In other words, when the port ring nozzle assembly of FIG. 8 is used, four ports redirect inlet steam flow from direction A to steam flow direction C; and four more ports direct inlet steam flow from direction A to direction B, thus off-setting the effects of thrust which would otherwise be experienced by the turbomachine. This lessened thrust load enables the use of smaller thrust bearings, reducing the lube oil requirements of the turbine and resulting in smaller, less-expensive lube system components.

Once the desired port ring nozzle assembly 135 is installed into the valve housing 2 of the turbine assembly 1, the assembly operates as follows. Steam is directed into the manifold casing 12 from either one or more than one inlet 16, 18. An actuator mechanism 37 which may be manual, or is preferably automated (e.g. pneumatic, hydraulic, electric, etc.) as would be readily understood in the field, is connected via connectors 24 to lift pins 138–141, which are connected to the lift bars 42, 44 which are, in turn, connected to the valve stems 54–68 of the corresponding valves 70–84 which rest in the valve seats 86–100, respectively. The actuating mechanism 37, in concert with the predetermined valve stem lengths, determines the precision with which the steam flow to the turbine wheels 36 may be regulated. Valve stems 54–68 having intentionally varying lengths are attached to valves 70–84. The hydraulic or pneumatic piston of the actuator mechanism 35 actuates rod 34 which moves connected lever arm 26 which pivots about pivot point 28 to push down or pull up on the lift pins connected to connector 24. As the lift pins are raised or lowered, so are the lift bars to which the lift pins are attached. The lift bars then raise or lower the valve stems, either removing the valves from the valve seats allowing steam to flow through the now open passage, or replacing the valves into the seats, thereby blocking steam passage therethrough. In a preferred embodiment as shown in FIG. 6, both lift bars have a number of vertically disposed openings extending through the bars. The valve stems have a diameter that is smaller than the bar openings and may pass therethrough. The lifting of lift bars causes the valves to be raised from their valve seats in a predetermined pattern by which steam flow to the blades of the turbine wheels is initiated, increased, decreased or terminated as desired. As shown in FIG. 6, lift pins 138–141 are initially raised by actuating mechanism 37 with enough force to raise lower lift bar 44, overcoming the pressure exerted on lower lift bar 44 by the incoming steam indicated by arrow A. As lower lift bar 44 continues to be raised, the bar will eventually first contact valve stop shoulder 71 connected to valve stem 56 of valve 72. As valve 72 is lifted from valve seat 88, steam flows through passageway 104. As valve 72 is more fully raised out of the valve seat 88, steam flow will proceed more fully through passageway 104. As lower lift bar 44 continues to be raised, valve 84 will be lifted from valve seat 100, followed by valve 80, then valve 76 and finally, valve 82.

The actuator is reversed to lower the lift bars. It is understood that, as the actuator lowers the lift bars and consequently the valve stem and attached valves, the weight of the lift bars, valve stem and valves is sufficient to overcome the steam pressure and return the valves to their "closed" position, at rest in their valve seats, blocking steam flow through the valve passages. The closing action may be complemented by adding springs or weights as required, and as would be readily understood by those skilled in the field.

Depending upon the desired flow characteristics of the turbine system, the actuator may also raise, independently, the lift pins regulating the upper lift bar which is responsible for raising valves 70, 74, and 78 from their valve seats. It is understood that the actuating mechanisms 37 can be programmed, as would be readily understood, to achieve with great precision any balance of, or change in, desired steam flow rate. Such may be accomplished by combining the actuating of the two lift bars one at a time, or together to regulate the steam flow as desired. It is further contemplated that the actuating mechanisms may be attached to a programmed computer to receive operating instructions remotely, or may be integrally programmed itself. The port ring nozzle assembly of the present invention and the lift bar valve assembly may be used together or separately to precisely regulate and control steam flow in a turbomachine. The port ring and lift bar valve assembly of the present invention are made from materials which are preferably thermodynamically selected based upon the selected motive fluid and the desired use of the turbine fitted with the disclosed improvements.

The present invention further contemplates any means of a lift bar valve assembly which can operate in the manner as already described. It is conceivable that one sufficiently thick and balanced lift pin could be responsible for lifting a lift bar. Further, the lift pins need not pass through the lift bars, as in the preferred embodiment, but may be constructed in a way, such as with multiple parallel struts or other means as would be readily apparent, such that the lift pins are capable of lifting the bars. In this way, the lift pins would not need to pass through an opening in the lift bars, but may surround, or cradle the lift bar.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A valve apparatus for a turbomachine comprising:

a manifold casing defining a valve inlet chamber, said manifold casing comprising a top wall and a bottom wall with a plurality of vertically disposed openings through said top wall, and a plurality of openings to vertically disposed passages in said bottom wall, said passages each extending away from said bottom wall to a passage exit;

a valve lift assembly comprising a plurality of lift bars, and a plurality of lift pins, said lift pins extending vertically through the vertically disposed openings at the top wall of the manifold casing;

a plurality of valve assemblies equal in number to that of vertically disposed passages in the bottom wall, said valve assemblies comprising a valve configured to fit sealingly against the corresponding vertically disposed opening and a valve stem with one end connected to a corresponding valve and an opposite end connected to a valve stop shoulder to place each of the valve assemblies in movable association with at least one of said lift bars; and a port ring nozzle assembly comprising a plurality of ports at least equal in number to the number of vertically disposed passages, said nozzle assembly disposed such that said ports abut the passage exits, with a first number of ports dedicated to direct a fluid in a first direction, and a second number of ports dedicated to direct a fluid in a second direction substantially opposite to the first direction.

2. The valve apparatus according to claim 1, further comprising a port ring nozzle assembly comprising a plurality of ports at least equal in number to the number of vertically disposed passages, said nozzle assembly disposed such that said ports abut the passage exits, with a first number of ports dedicated to direct a flow of steam in a first direction, and a second number of ports dedicated to direct a flow of steam in a second direction substantially opposite to the first direction.

3. The valve apparatus of claim 1, wherein the ports direct steam flow to turbine blades of a turbine wheel.

4. The valve apparatus of claim 1, wherein said lift bars each comprise a number of openings of a first diameter extending vertically through each bar, and said valve stems have a second diameter that is less than the openings of a first diameter, such that each said valve stem is placed through one opening of at least one of said bars, with said valve stop shoulder having a third diameter larger than the first diameter of said openings.

5. The valve apparatus of claim 1, further comprising an actuating mechanism for raising and lowering the lift pins, said actuating mechanism comprising couplers attached to the lift pin, a pivoting lever arm having a first and second end, said first end connected to the coupler and the second end connected to an actuator arm, said arm connected to a piston.

6. The valve apparatus of claim 5, wherein said piston is driven by hydraulic pressure.

7. The valve apparatus of claim 5, wherein the piston is driven by pneumatic pressure.

8. The valve apparatus of claim 5, wherein said actuating mechanism is capable of raising a lift bar to a distance sufficient to withdraw at least one valve from at least one valve seat of at least one passage.

9. The valve apparatus of claim 1, wherein the length of the valve stems are varied relative to one another.

10. The valve apparatus of claim 1, wherein the lift bar engages the stop shoulders of the valve assemblies in a predetermined order whereby the valves are lifted from their valve seats sequentially.

11. A steam turbine comprising:

a large exhaust housing;

a small exhaust housing;

a plurality of diaphragms positioned within the exhaust housings comprising a stationary set of blades for directing steam flow;

a plurality of rotatable turbine wheels positioned within the exhaust housings and mounted onto a turbine shaft and positioned adjacent said diaphragms, said turbine wheels having a set of blades;

a valve housing configured to fit sealingly between the small and large exhaust housings, said valve housing comprising a manifold casing defining a valve inlet chamber, said manifold casing comprising a top wall and a bottom wall with a plurality of vertically disposed openings through said top wall, and a plurality of openings to vertically disposed passages in said bottom wall, said passages each extending from said bottom wall to a passage exit;

a valve lift assembly comprising a plurality of lift bars, and a plurality of lift pins, said lift pins extending vertically through the vertically disposed openings at the top wall of the manifold casing;

a plurality of valve assemblies equal in number to that of vertically disposed passages in the bottom wall, said valve assemblies comprising a valve configured to fit sealingly against the corresponding vertically disposed opening and a valve stem with one end connected to a corresponding valve and an opposite end connected to a valve stop shoulder to place each of the valve assemblies in movable association with at least one of said lift bars; and a port ring nozzle assembly comprising a plurality of ports at least equal to the number of vertically disposed passages, said nozzle assembly disposed such that said ports abut the passage exits, with a first set of ports dedicated to direct a fluid in a first direction, and a second set of ports dedicated to direct a fluid in a second direction substantially opposite to the first direction.

12. The turbine according to claim 11, further comprising a port ring nozzle assembly comprising a plurality of ports at least equal to the number of vertically disposed passages, said nozzle assembly disposed such that said ports abut the passage exits, with a first set of ports dedicated to direct a flow of steam in a first direction, and a second set of ports dedicated to direct a flow of steam in a second direction substantially opposite to the first direction.

13. The turbine according to claim 11, wherein the ports direct steam flow to turbine blades of a turbine wheel.

14. The turbine according to claim 11, wherein said lift bars each comprise a number of openings of a first diameter extending vertically through each bar, and said valve stems have a second diameter less than the first diameter, such that each said valve stem is placed through one opening of at least one of said lift bars, with said valve stop shoulder having a third diameter larger than the first diameter of said openings.

15. The turbine according to claim 11, further comprising an actuating mechanism for raising and lowering the lift pins, said actuating mechanism comprising couplers attached to the lift pins, a pivoting lever arm having a first and second end, said first end connected to the coupler and the second end to an actuator arm, said arm connected to a piston.

16. The turbine according to claim 15, wherein said piston is driven by hydraulic pressure.

17. The turbine according to claim 15, wherein the piston is driven by pneumatic pressure.

18. The turbine according to claim 15, wherein said actuating mechanism is capable of raising a lift bar to a distance sufficient to withdraw at least one valve from at least one valve seat of at least one passage.

19. The turbine according to claim 11, wherein the lift bar engages the stop shoulder of the valve assemblies in a predetermined order whereby the valves are lifted from their valve seats sequentially.

20. A bidirectional flow port ring nozzle assembly for a turbomachine comprising a first and second side, and a top and a bottom, and having a plurality of ports equal in number to and aligned with a plurality of passage exits from a valve housing, said ports originating in the nozzle assembly top and extending into the ring nozzle and exiting from either the first or second side of the ring nozzle, said top of the nozzle assembly configured to fit sealingly against the valve housing, with a first set of ports dedicated to direct a fluid in a first direction, and a second set of ports dedicated to direct a fluid in a second direction substantially opposite to the first direction.

21. A method for admitting a controlled steam flow through a turbomachine comprising:

providing a control system comprising a plurality of valve assemblies located within a manifold housing of a steam valve housing, said valve assemblies comprising a valve, a valve stem, and a valve stop shoulder;

attaching each valve assembly to a lift bar assembly by passing said valve stem through openings in the lift bar and placing said stop shoulder on the valve stem to retain said valve stem on said lift bar;

attaching the lift bar assembly to an actuating mechanism;

admitting a steam flow to the manifold housing;

actuating an actuating mechanism to raise said lift bar assembly such that at least one valve is raised from a corresponding valve seat covering the passage to a port in a ring nozzle assembly, wherein the port ring nozzle assembly comprises a plurality of ports at least equal to the number of vertically disposed passages, said nozzle assembly disposed such that said ports abut the passage exits, with a first set of ports dedicated to direct a fluid in a first direction, and a second set of ports dedicated to direct a fluid in a second direction substantially opposite to the first direction; and passing the steam flow through the passage into the corresponding port in the ring nozzle assembly, said steam directed through said ring nozzle assembly in at least one direction.

22. The method of claim 21, wherein the port ring nozzle assembly comprises a plurality of ports at least equal to the number of vertically disposed passages, said nozzle assembly disposed such that said ports abut the passage exits, with a first set of ports dedicated to direct a flow of steam in a first direction, and a second set of ports dedicated to direct a flow of steam in a second direction substantially opposite to the first direction.

23. The method of claim 21, wherein a plurality of valves is raised and the steam flow is simultaneously passed through multiple passages and into multiple corresponding ports in the ring nozzle assembly, said steam directed through a number of said ports in a first direction, and through a number of said ports in a second direction substantially opposite to the first direction.

24. The method of claim 21, wherein said actuating mechanism comprises couplers attached to the lift pins, a pivoting lever arm having a first and second end, said first end connected to the coupler and the second end to an actuator arm, said arm connected to a piston.

25. The method of claim 24, wherein said piston is driven by hydraulic pressure.

26. The method of claim 24, wherein the piston is driven by pneumatic pressure.

27. The method of claim 21 wherein said actuating mechanism is capable of raising a lift bar to a distance sufficient to withdraw at least one valve from at least one valve seat of at least one passage.

28. The method of claim 21, wherein the lift bar engages the stop shoulders of the valve assemblies in a predetermined order whereby the valves are lifted from their valve seats sequentially.

29. The method of claim 21, wherein the ports direct steam flow to turbine blades of a turbine wheel.

* * * * *